US009283419B2

(12) United States Patent
Chen

(10) Patent No.: US 9,283,419 B2
(45) Date of Patent: Mar. 15, 2016

(54) INFLATABLE TRAMPOLINE PAD

(71) Applicant: Samuel Chen, Shanghai (CN)

(72) Inventor: Samuel Chen, Shanghai (CN)

( * ) Notice: Subject to any disclaimer, the term of this patent is extended or adjusted under 35 U.S.C. 154(b) by 52 days.

(21) Appl. No.: 14/151,196

(22) Filed: Jan. 9, 2014

(65) Prior Publication Data

US 2015/0190666 A1 Jul. 9, 2015

(51) Int. Cl.

| | |
|---|---|
| ***A63B 5/11*** | (2006.01) |
| ***A63B 71/02*** | (2006.01) |
| *A63B 21/02* | (2006.01) |
| *A63B 71/00* | (2006.01) |

(52) U.S. Cl.

CPC ..... *A63B 5/11* (2013.01); *A63B 71/022* (2013.01); *A63B 21/02* (2013.01); *A63B 2071/009* (2013.01); *A63B 2210/50* (2013.01); *A63B 2225/62* (2013.01)

(58) Field of Classification Search

CPC ..... A63B 5/11; A63B 2225/62; A63B 21/02; A63B 71/022; A63B 2071/009; A63B 2067/005

USPC ..... 482/26–29, 77, 78; 472/134, 136, 135; 446/220–226

See application file for complete search history.

(56) References Cited

U.S. PATENT DOCUMENTS

| | | | | |
|---|---|---|---|---|
| 3,195,890 | A * | 7/1965 | Salls | A63B 25/08 482/128 |
| 4,516,767 | A * | 5/1985 | Eskijian | A63B 5/11 482/27 |
| 5,385,518 | A * | 1/1995 | Turner | A63B 5/11 482/23 |
| 5,810,695 | A * | 9/1998 | Sass | 482/27 |
| 6,001,045 | A * | 12/1999 | Gift | A63B 5/11 482/27 |
| 6,193,632 | B1 * | 2/2001 | Steger | A63B 5/11 482/27 |
| 6,223,673 | B1 * | 5/2001 | Mears et al. | 114/264 |
| 6,336,893 | B1 * | 1/2002 | Chen | 482/29 |
| 6,447,426 | B2 * | 9/2002 | Peterson | A63B 5/11 114/311 |
| 6,918,846 | B2 * | 7/2005 | Chen | 473/479 |
| 7,150,699 | B2 * | 12/2006 | Yang | 482/27 |
| 7,731,594 | B1 * | 6/2010 | Hansen | 472/93 |
| 7,833,132 | B2 * | 11/2010 | Hylbert et al. | 482/27 |
| D717,899 | S * | 11/2014 | Chen | D21/797 |
| 2002/0183166 | A1 * | 12/2002 | Chen | 482/29 |
| 2003/0064861 | A1 * | 4/2003 | Chen | 482/27 |
| 2007/0111860 | A1 * | 5/2007 | Publicover | 482/27 |
| 2009/0264042 | A1 * | 10/2009 | Chen | 446/221 |
| 2010/0210422 | A1 * | 8/2010 | Crawford | A63B 5/11 482/27 |
| 2011/0136597 | A1 * | 6/2011 | Gordon | 473/478 |

* cited by examiner

*Primary Examiner* — Loan H Thanh
*Assistant Examiner* — Gregory Winter
(74) *Attorney, Agent, or Firm* — Clement Cheng

(57) ABSTRACT

A trampoline includes a trampoline frame and trampoline bed. The trampoline frame is connected to springs and the springs in turn support the trampoline bed. A trampoline enclosure has enclosure poles. An inflatable ring is formed around the trampoline frame. Inflatable posts are attached to the enclosure poles. The trampoline enclosure has enclosure poles that enclose at least a portion of the inflatable ring. The inflatable ring is anchored by an anchor, and the anchor is formed as a fluid chamber configured to retain fluid. The anchor is configured to rest on a ground surface. The anchor can connect to a distal side or a bottom surface of the inflatable ring. The inflatable ring can be formed as a trampoline pad that is configured to cover the springs. Entrance panel is configured for releasable sealing.

15 Claims, 3 Drawing Sheets

INFLATABLE TRAMPOLINE PAD

FIELD OF THE INVENTION

The present invention is in the field of trampolines.

DISCUSSION OF RELATED ART

A wide variety of different trampolines have trampoline pads for covering springs and frames. Trampoline pads have a variety of different configurations. The springs should be covered so that they are not in contact with a user.

SUMMARY OF THE INVENTION

A trampoline comprises a trampoline frame and trampoline bed. The trampoline frame is connected to springs and the springs in turn support the trampoline bed. A trampoline enclosure has enclosure poles. An inflatable ring is formed around the trampoline frame. Inflatable posts are attached to the enclosure poles. The trampoline enclosure has enclosure poles that enclose at least a portion of the inflatable ring. The inflatable ring is anchored by an anchor, and the anchor is formed as a fluid chamber configured to retain fluid. The anchor is configured to rest on a ground surface. The anchor can connect to a distal side or a bottom surface of the inflatable ring. The inflatable ring can be formed as a trampoline pad that is configured to cover the springs.

An enclosure netting is attached to and installed between enclosure poles. The enclosure netting installed between the enclosure poles form panels. Enclosure poles have a top end connecting to a top ring. The top ring defines a top opening. An entrance panel is defined on a portion of enclosure netting, and the entrance panel is configured for releasable sealing.

Figure 1:
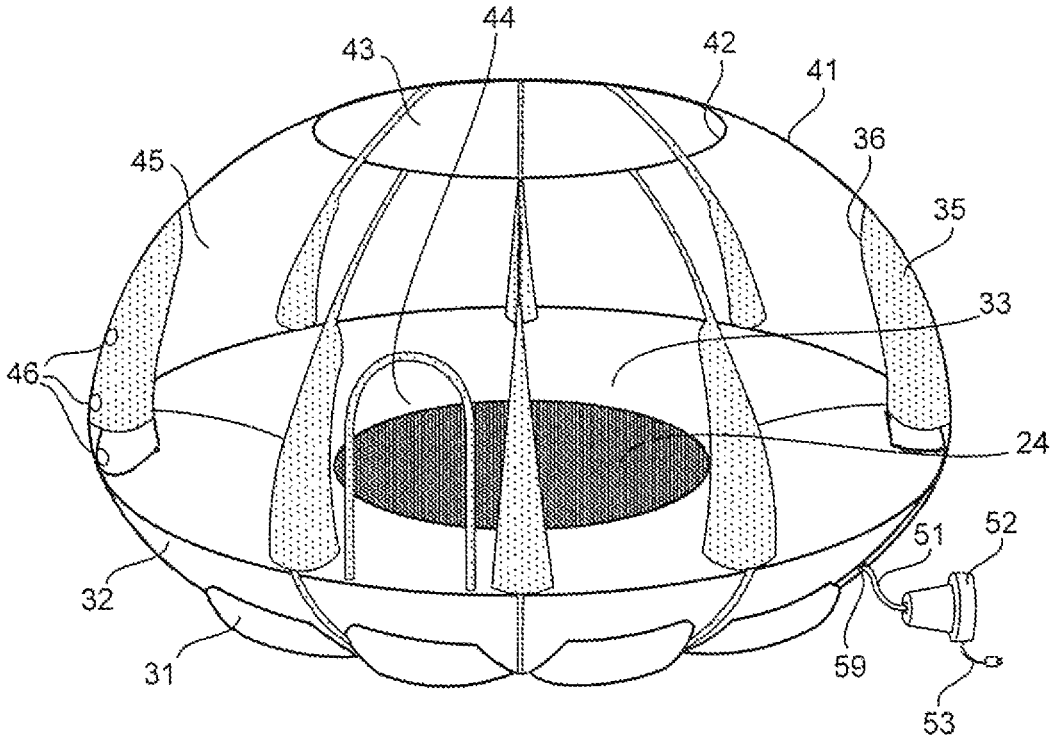
FIG. 1 is a perspective view diagram of the present invention.

The following callout list of elements can be a useful guide in referencing the element numbers of the drawings.

21 Trampoline Frame
22 Trampoline Leg
23 Trampoline Leg Footing
24 Trampoline Bed
31 Anchor
32 Inflatable Ring
33 Inflatable Pad
34 Top Surface Of Inflatable Ring
35 Inflatable Post
36 Inflatable Post Surface
37 Indentation
38 Lower Extension
39 Outside Extension
41 Enclosure Pole
42 Top Ring
43 Enclosure Net Top Opening
44 Entrance Panel Door
45 Enclosure Net
46 Enclosure Pole Connector
51 Air Hose
52 Air Pump

53 Plug
61 Upper Inflatable Connector
62 Lower Inflatable Connector
87 Spring Cover
88 Spring

DETAILED DESCRIPTION OF THE PREFERRED EMBODIMENT

A trampoline typically includes a trampoline frame 21 and a trampoline leg 22. The trampoline frame 21 also has sections that are connected together at sockets. The trampoline leg 22 can be connected into a socket so that it is rigidly connected to the trampoline frame 21. The trampoline frame and trampoline leg can be made of tubular metal members that are bent to proper configuration. The trampoline leg 22 may further include a trampoline leg footing 23 formed as a horizontal member that is connected to vertical members of the trampoline leg 22. The trampoline can be made to allow hand assembly without use of tools. Alternatively, a set screw can be used for having set screw connections of the tubular metal members. The set screw provides more durable connection, however it suffers from being more difficult to disassemble and takedown quickly in case of sudden wind gusts.

A trampoline typically has springs that connect between the trampoline bed 24 and the trampoline frame 21. The springs can be helical springs, torsion springs or flexible rod members. The helical springs can be doubled up so that a pair of helical portions is connected to a single connection hook on each side of the helical spring. The helical spring can also be doubled up with a larger diameter coil passing around a smaller diameter coil within the larger diameter coil. The springs can also be flexible rod members formed as fiberglass or steel rods that are initially straight, but bend when biased. The springs can also be torsion springs that have hook ends expanding and contracting a coil spring instead of pulling on the coil as in the case of a helical spring.

The trampoline pad 33 is inflatable and overlies a portion of the trampoline frame. The trampoline pad may have a dampening portion such as a foam padding portion in addition to the inflatable portion. The foam padding portion can be a top or bottom layer of the trampoline pad 33. The trampoline pad 33 can be connected to an inflatable ring 32 that allows for inflation of the trampoline pad and inflatable ring 32 together. The inflatable ring 32 passes around the periphery of the trampoline frame 21. Also, the trampoline pad 33 passes around the periphery of the trampoline frame 21.

The inflatable ring 32 is anchored by an anchor 31. The anchor 31 is preferably a fluid chamber adapted to be capable of receiving air, water or sand. For example, a port 63 can be formed on an outside surface of the anchor 31. The port 63 can be covered by a lid that has a threaded closure to provide an opening and closing of the port 63 for filling up and emptying the anchors 31. The anchor 31 is attached to a side or bottom side of the inflatable ring 32. The anchor 31 can be integrally formed with the inflatable ring 34 such as by folding a long strip of waterproof plastic into a torus shape for stitching to the external surface of the inflatable ring. If stitching is used to connect to the anchor 31 to the inflatable ring 32, waterproof sealing tape is preferred for retaining fluid within the anchor 31. The anchor can also be strapped and hung over along an outside external surface of the inflatable ring 32.

The inflatable ring 32 has a top side that is a top surface of the inflatable ring 34. The top surface of the inflatable ring 34 provides a margin area for users to stand while a jumper is jumping on the trampoline. The top surface of the inflatable ring 34 can be treated with an antibacterial coating and antislip coating for user comfort. The margin area should be sized so that an adult can stand on the margin area and supervise a child jumping on the trampoline bed 24 area. The inflatable ring 32 can be said to have an inflatable pad 33 extension that overlies and covers the frame 21 and springs. The springs are mounted on the periphery of the frame facing inward toward the trampoline bed so as to pull the trampoline bed taught and provide a bounding surface.

The trampoline also has a trampoline enclosure that is attached to the trampoline frame. The trampoline enclosure is attached to the trampoline leg 22 and can be attached to the trampoline leg footing 23. The trampoline enclosure includes a plurality of enclosure poles 41 such as eight enclosure poles oriented around an external periphery of the inflatable ring 32. The eight enclosure poles have an arc shaped profile that initially bend outward at a lower attachment and then bend back inward at an upper attachment. The lower attachment is preferably attached to a trampoline leg 22 and the upper attachment is preferably attached to a top ring 42. The lower attachment can be at a metal socket that is welded to the trampoline leg 22. The metal socket can be recessed inside and outside surface of the trampoline leg 22 so that it does not poke out and stab through product packaging during shipping. Alternatively, the metal socket can be mounted on an external surface of the trampoline leg 22 to provide more apparent and easier handling for a user.

If all of the enclosure poles 41 are attached to the top ring 42, the enclosure poles are bent in a bow or arc shaped to provide resilient structure. The top ring 42 can be made of a fiberglass or stainless steel metal ring. The top ring 42 can have a connector that connects a pair of top ring members. The pair of top ring members can be formed as sectional straight sticks of fiberglass that are bent into a ring to form the top ring 42 when the sectional straight sticks of fiberglass are connected together to form a full ring. The top ring is preferably approximately at least 6 feet above the trampoline bed 24. The diameter of the enclosure net opening 43 can be sized to be approximately equivalent to the diameter of the top ring.

Users enter the trampoline at an entrance panel door 44 there is formed in a panel of the enclosure net 45. The enclosure net 45 is connected to the enclosure poles 41 at connectors 46. The connectors can be a strap or sleeve type connection. The stability of the inflatable ring is also improved at an upper inflatable connection 61 formed between the indentation 37 and the trampoline frame 21. The inflatable ring is also preferably connected at a lower inflatable connection 62 between the trampoline leg 22 and the lower extension 38 of the inflatable ring. The outside extension of the inflatable ring pushes against the enclosure poles 41 at an outside extension 39 of the inflatable ring 32. The outside extension 39 extends around the periphery of the inflatable ring for catching wayward users.

The inflatable post 35 is attached to the inflatable ring 32 in open fluid communication so that pump air pressure can be transmitted through the hollow portion of the inflatable ring 32 and into the hollow portion of the inflatable post 35. The inflatable post 35 may have a tapered profile with a large diameter base that tapers to a slender tip. The inflatable post 35 can be filled with confetti or streamers that provide a visual effect. The inflatable post 35 has an external inflatable post surface 36 that repels users from hitting the enclosure pole 41. The external inflatable post surface 36 is preferably not grippy, but is preferably smooth to avoid head or appendage entrapment. The inflatable post can be modularly removable from the enclosure pole 41, such as by removable straps, or by a zipper connection to an attachment sleeve. The inflatable post is preferably always connected to the inflatable ring. A baffle with a sheet and small openings can be placed between the inflatable post and the inflatable ring. The inflatable post can be made transparent when confetti or streamers are enclosed within the inflatable post. The upper tip of the inflatable post may have an air exit to provide an upward airflow of the air from the inflatable ring to the upper tip of the inflatable post. An upward airflow can provide motion to fillers located within the inflatable post. The fillers can include confetti, streamers or hollow multicolored plastic balls.

The inflatable ring 32 is inflated by an air pump 52 that blows air from outside the inflatable ring 32 through an air hose 51 that is connected to an inflatable ring inflation opening 54. The air pump 52 formed as an air blower can be powered by household electric current from a plug 53 of the air pump 52. The air blower is preferably left in continuous operation as long as users are jumping on the trampoline. Users may or may not jump on the inflatable ring 32 itself. The trampoline pad portion that covers the frame and springs may have a different contrasting color from the remainder of the inflatable ring 32.

Figure 2:
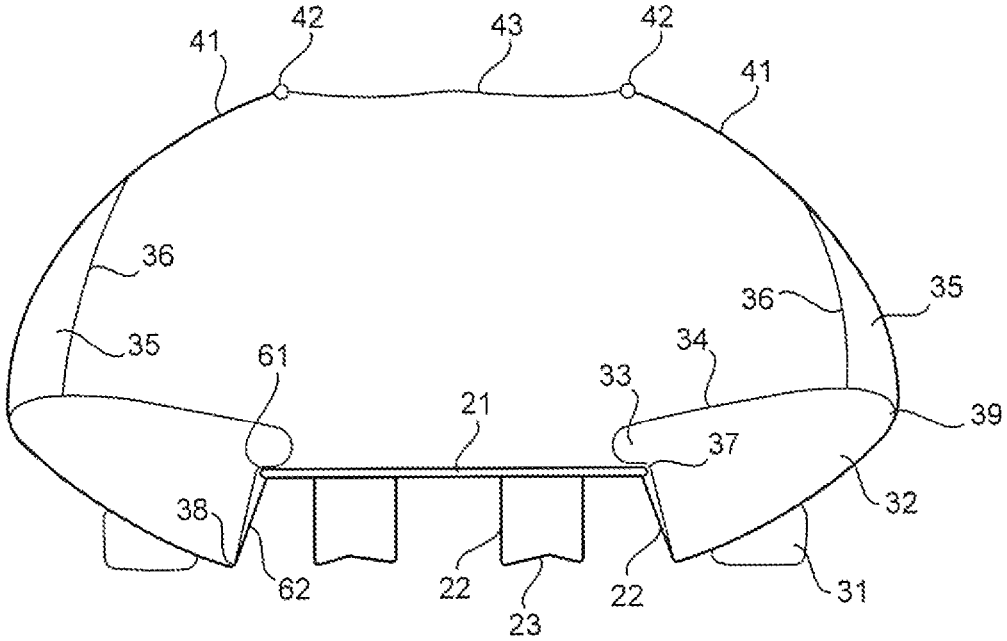
FIG. 2 is a cross section diagram of the present invention.
Figure 3:
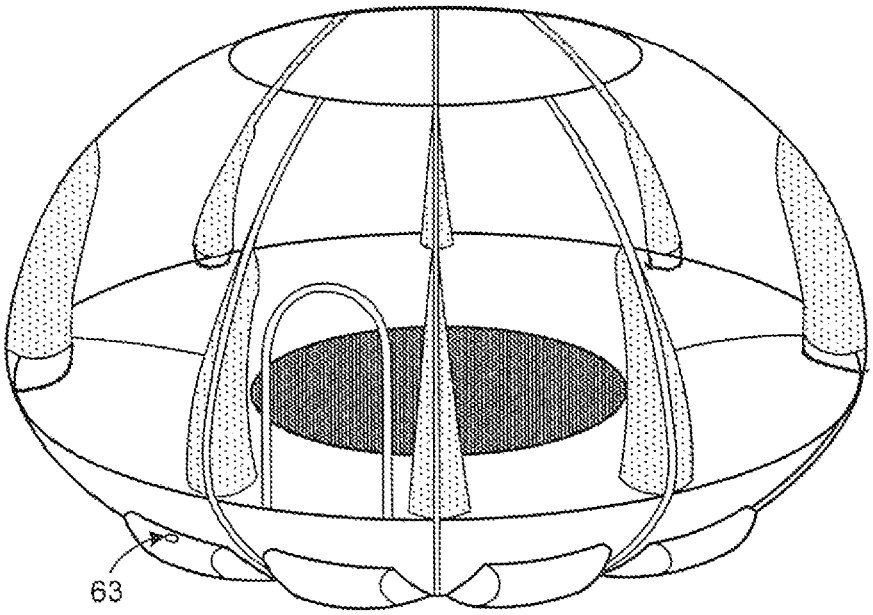
FIG. 3 is a perspective view diagram of the present invention.
Figure 4:
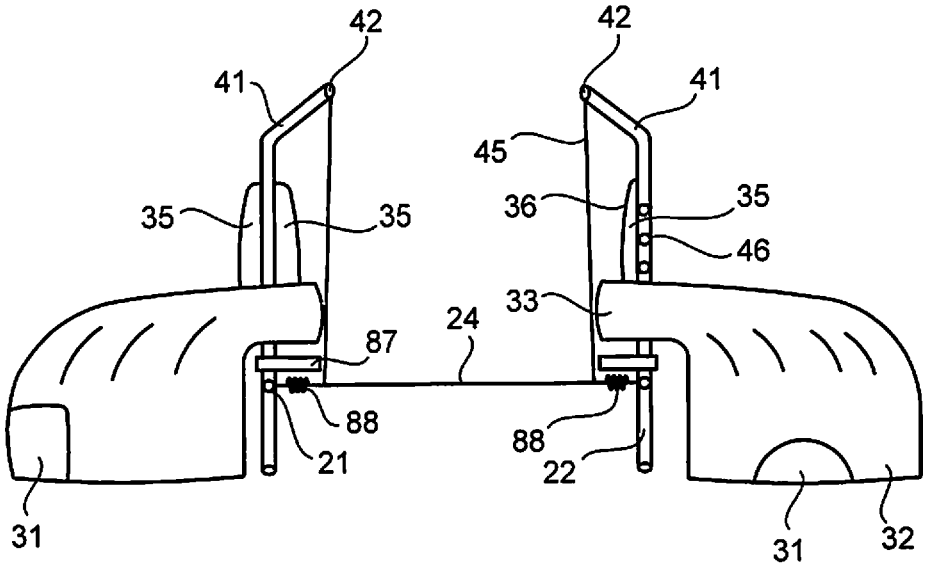
FIG. 4 is a cross section diagram of the present invention in retrofit configuration.

As seen in FIG. 2, the design sizing of the inflatable ring 32 is such that it has a large surface area of the top surface of inflatable ring 34 in comparison to the surface of the trampoline bed 24. The outside extension 39 portion of the inflatable ring 32 can be decreased so that the surface area of the surface of the inflatable ring 34 is less than the surface area of the trampoline bed. In a retrofit configuration as seen in FIG. 4, the inflatable pad 33 and inflatable ring 32 remain present with the outside extension 39 and, lower extension 38 so that the trampoline pad fits on a standard trampoline having a standard trampoline enclosure, however, the inflatable post 35 is moved inward to remain attached to the enclosure pole 41.

Optionally, the inflatable post 35 can be made with a hollow conduit so that the inflatable post 35 forms a sleeve that insulates the entire lower periphery of the enclosure pole 41. Alternatively, the inflatable post can be secured to the enclosure pole 41 by straps. A spring cover 87 can be placed over the springs 88. The anchor 31 can be on the underside or outside corner of the inflatable ring 32.

The invention claimed is:

1. A trampoline comprising:

a. a trampoline frame and trampoline bed, wherein the trampoline frame is connected to springs, wherein the springs support the trampoline bed;

b. a trampoline enclosure having enclosure poles and wherein enclosure netting is attached to the enclosure poles;

c. an entrance panel defined on a portion of the enclosure netting, wherein the entrance panel is configured for releasable sealing;

d. an inflatable ring formed around the trampoline frame, wherein the inflatable ring has a top surface configured so that the top surface of the inflatable ring provides a margin area for users to stand upon; and e. an inflatable pad extension formed on the inflatable ring that overlies and covers the trampoline frame and the springs, wherein the inflatable pad extension extends inwardly from the inflatable ring, wherein the inflatable pad extension further includes an indentation that receives the trampoline frame.

2. The trampoline of claim 1, further comprising inflatable posts attached to the enclosure poles.

3. The trampoline of claim 1, wherein the enclosure poles enclose at least a portion of the inflatable ring.

4. The trampoline of claim 1, wherein the inflatable ring is anchored by an anchor, wherein the anchor is formed as a fluid chamber configured to retain fluid, wherein the anchor is configured to rest on a ground surface.

5. The trampoline of claim 1, wherein the inflatable ring is formed as a trampoline pad that is configured to cover the springs.

6. The trampoline of claim 5, further comprising inflatable posts attached to the enclosure poles.

7. The trampoline of claim 5, wherein the enclosure poles enclose at least a portion of the inflatable ring.

8. The trampoline of claim 5, wherein the inflatable ring is anchored by an anchor, wherein the anchor is formed as a fluid chamber configured to retain fluid, wherein the anchor is configured to rest on a ground surface.

9. The trampoline of claim 8, wherein the anchor is attached to a distal side of the inflatable ring.

10. The trampoline of claim 8, wherein the anchor is attached to a lower side of the inflatable ring.

11. The trampoline of claim 8, wherein the enclosure poles have a top end connecting to a top ring, wherein the top ring defines a top opening.

12. The trampoline of claim 1, wherein the enclosure poles have a top end connecting to a top ring, wherein the top ring defines a top opening.

13. The trampoline of claim 12, further comprising inflatable posts attached to the enclosure poles.

14. The trampoline of claim 12, wherein the enclosure poles enclose at least a portion of the inflatable ring.

15. The trampoline of claim 12, wherein the inflatable ring is anchored by an anchor, wherein the anchor is formed as a fluid chamber configured to retain fluid, wherein the anchor is configured to rest on a ground surface.

* * * * *